US008542060B2

(12) United States Patent
Tomioka et al.

(10) Patent No.: US 8,542,060 B2
(45) Date of Patent: Sep. 24, 2013

(54) CONSTANT CURRENT CIRCUIT

(75) Inventors: Tsutomu Tomioka, Chiba (JP); Masakazu Sugiura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 22 days.

(21) Appl. No.: 13/210,598

(22) Filed: Aug. 16, 2011

(65) Prior Publication Data

US 2012/0062312 A1 Mar. 15, 2012

(30) Foreign Application Priority Data

Sep. 14, 2010 (JP) ..... 2010-205700

(51) Int. Cl.
*G05F 1/10* (2006.01)
*G05F 3/02* (2006.01)

(52) U.S. Cl.
USPC ..... 327/543; 327/538; 327/539; 323/313; 323/315

(58) Field of Classification Search
USPC ..... 327/530, 538–543, 546; 323/312–317
See application file for complete search history.

(56) References Cited

U.S. PATENT DOCUMENTS

| | | | | |
|---|---|---|---|---|
| 5,391,979 | A | 2/1995 | Kajimoto et al. | |
| 5,889,431 | A * | 3/1999 | Csanky | 327/543 |
| 6,332,661 | B1 * | 12/2001 | Yamaguchi | 327/108 |
| 6,870,421 | B2 * | 3/2005 | Abe | 327/539 |
| 7,362,166 | B2 * | 4/2008 | Ausserlechner | 327/543 |
| 8,269,478 | B2 * | 9/2012 | Chao et al. | 323/315 |
| 2006/0170490 | A1 * | 8/2006 | Bedarida et al. | 327/543 |
| 2009/0302823 | A1 * | 12/2009 | Chao et al. | 323/313 |
| 2010/0156386 | A1 * | 6/2010 | Imura | 323/313 |
| 2010/0219804 | A1 * | 9/2010 | Thorp | 323/313 |
| 2011/0156822 | A1 * | 6/2011 | Takano et al. | 331/57 |
| 2012/0249227 | A1 * | 10/2012 | Nakayama et al. | 327/543 |

* cited by examiner

*Primary Examiner* — Lincoln Donovan
*Assistant Examiner* — Brandon S Cole
(74) *Attorney, Agent, or Firm* — Brinks Hofer Gilson & Lione

(57) ABSTRACT

A constant current circuit includes a depletion type MOS transistor, a first current mirror circuit, and a second current mirror circuit. The first and second current mirror circuits each include first and second MOS transistors where a gate of the first and second MOS transistors is connected to a drain of the first MOS transistor. A third MOS transistor has a gate connected to one terminal of a resistor and to the drain of the first MOS transistor of the first current mirror circuit, a source connected to a ground terminal, and a drain connected to an output terminal of the second current mirror circuit.

2 Claims, 13 Drawing Sheets

CONSTANT CURRENT CIRCUIT

RELATED APPLICATIONS

This application claims priority under 35 U.S.C. §119 to Japanese Patent Application No. 2010-205700 filed on Sep. 14, 2010, the entire content of which is hereby incorporated by reference.

BACKGROUND OF THE INVENTION

1. Field of the Invention

The present invention relates to a constant current circuit.

2. Description of the Related Art

A conventional constant current circuit is described. FIG. 13 is a diagram illustrating a conventional constant current circuit.

An increase in a current Iref that flows in a resistor 54 raises a voltage generated in the resistor 54 and accordingly raises the gate-source voltage of an NMOS transistor 52, with the result that the conductance of the NMOS transistor 52 is increased. This reduces the gate voltage of an NMOS transistor 53, which leads to a lower gate-source voltage of the NMOS transistor 53 and a smaller conductance of the NMOS transistor 53. The current Iref is therefore reduced. A reduction in the current Iref that flows in the resistor 54 increases the current Iref because of the similar operation of the NMOS transistor 52 and the NMOS transistor 53. The conventional constant current circuit keeps the current Iref constant by operating in the manner described above (see, for example, JP 06-132739 A (FIG. 12)).

In prior art, when the power supply voltage is given as VDD, the gate-source voltage of a PMOS transistor 51 is given as Vgsp, the drain-source voltage of the NMOS transistor 53 is given as Vdsn, and the gate-source voltage of the NMOS transistor 52 is given as Vgsn, the constant current circuit needs to satisfy the following Expression (31) in order to operate properly:

$$VDD>|Vgsp|+Vdsn+Vgsn \quad (31)$$

From Expression (31), the power supply voltage VDD needs to be higher than 1.6 V in order for the constant current circuit to operate properly when, for example, the gate-source voltage |Vgsp| and the gate-source voltage Vgsn are each 0.7 V and the drain-source voltage Vdsn is 0.2 V. In other words, the minimum operating power supply voltage is 1.6 V.

SUMMARY OF THE INVENTION

The present invention has been made in view of the above, and an object of the present invention is therefore to provide a constant current circuit capable of operating on a lower power supply voltage.

In order to attain the above object, a constant current circuit according to the present invention is structured as follows.

A constant current circuit according to an aspect of the present invention includes: a first depletion type MOS transistor of a second conductivity type, which has a drain connected to a first power supply terminal and which serves as a current source; a first current mirror circuit which includes a first MOS transistor of the second conductivity type serving as an input-side transistor and having a source connected to a second power supply terminal and a second MOS transistor of the second conductivity type serving as an output-side transistor and having a source connected to the second power supply terminal, and which mirrors a current that flows in the first depletion type MOS transistor of the second conductivity type; a second current mirror circuit which includes a first MOS transistor of a first conductivity type serving as an input-side transistor and having a source connected to the first power supply terminal and a second MOS transistor of the first conductivity type serving as an output-side transistor and having a source connected to the first power supply terminal, and which mirrors a current that flows in the first current mirror circuit; a resistor which is provided between a source of the first depletion type MOS transistor of the second conductivity type and a drain of the first MOS transistor of the second conductivity type; and a third MOS transistor of the second conductivity type, which has a gate connected to one terminal of the resistor, a source connected to the second power supply terminal, and a drain connected to an output terminal of the second current mirror circuit, in which a gate of the first MOS transistor of the second conductivity type is connected to another terminal of the resistor, and a gate of the first depletion type MOS transistor of the second conductivity type is connected to the output terminal of the second current mirror circuit.

Further, a constant current circuit according to another aspect of the present invention includes: a first depletion type MOS transistor of a second conductivity type, which has a drain connected to a first power supply terminal and which serves as a current source; a first current mirror circuit which includes a first MOS transistor of the second conductivity type serving as an input-side transistor and having a source connected to a second power supply terminal and a second MOS transistor of the second conductivity type serving as an output-side transistor and having a source connected to the second power supply terminal, and which mirrors a current that flows in the first depletion type MOS transistor of the second conductivity type; a resistor which is provided between a source of the first depletion type MOS transistor of the second conductivity type and a drain of the first MOS transistor of the second conductivity type; a third MOS transistor of the second conductivity type, which has a gate connected to one terminal of the resistor and a source connected to the second power supply terminal; and a second current mirror circuit which includes a first MOS transistor of a first conductivity type serving as an input-side transistor and having a source connected to the first power supply terminal and a second MOS transistor of the first conductivity type serving as an output-side transistor and having a source connected to the first power supply terminal, and which mirrors a current that flows in the third MOS transistor of the second conductivity type, in which a gate of the first MOS transistor of the second conductivity type is connected to another terminal of the resistor, and a gate of the first depletion type MOS transistor of the second conductivity type is connected to an output terminal of the second current mirror circuit.

A constant current circuit of the present invention structured as above can operate if the power supply voltage is higher than a voltage that is the sum of the drain-source voltage of the first depletion type MOS transistor of the second conductivity type and the gate-source voltage of the second MOS transistor of the second conductivity type. The resultant effect is that a constant current circuit of the present invention is lower in minimum operating voltage than conventional constant current circuits.

DETAILED DESCRIPTION OF THE PREFERRED EMBODIMENT

An embodiment of the present invention is described below with reference to the drawings.

Figure 1:
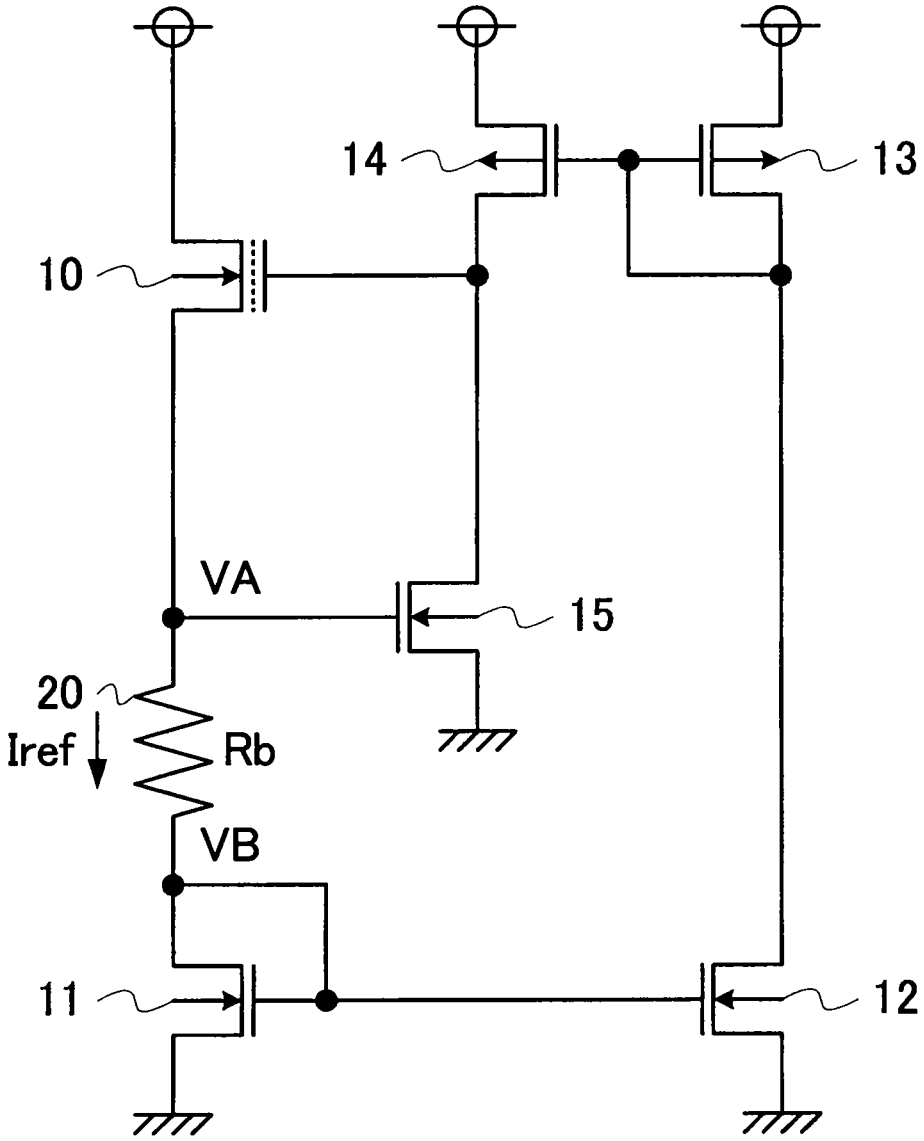
FIG. 1 is a diagram illustrating a constant current circuit according to an embodiment of the present invention.

The structure of a constant current circuit is described first. FIG. 1 is a diagram illustrating a constant current circuit according to the embodiment.

The constant current circuit of this embodiment includes a depletion type NMOS transistor 10, NMOS transistors 11 and 12, PMOS transistors 13 and 14, an NMOS transistor 15, and a resistor 20.

A gate of the NMOS transistor 11 is connected to a drain of the NMOS transistor 11, one end of the resistor 20, and a gate of the NMOS transistor 12. A source of the NMOS transistor 11 is connected to the ground terminal. The NMOS transistor 11 is wired in a saturated manner. A source of the NMOS transistor 12 is connected to a ground terminal. A gate of the PMOS transistor 13 is connected to a drain of the PMOS transistor 13, a gate of the PMOS transistor 14, and a drain of the NMOS transistor 12. A source of the PMOS transistor 13 is connected to the power supply terminal The PMOS transistor 13 is wired in a saturated manner. A source of the PMOS transistor 14 is connected to the power supply terminal, and a drain of the PMOS transistor 14 is connected to a gate of the depletion type NMOS transistor 10 and a drain of the NMOS transistor 15. A gate of the NMOS transistor 15 is connected to a source of the depletion type NMOS transistor 10 and the other end of the resistor 20. A source of the NMOS transistor 15 is connected to the ground terminal. A drain of the depletion type NMOS transistor 10 is connected to the power supply terminal.

The PMOS transistors 13 and 14 constitute a current mirror circuit, with the drain of the PMOS transistor 13 serving as an input terminal of the current mirror circuit and the drain of the PMOS transistor 14 serving as an output terminal of the current mirror circuit. The NMOS transistors 11 and 12 constitute a current mirror circuit, with the drain of the NMOS transistor 11 serving as an input terminal of the current mirror circuit and the drain of the NMOS transistor 12 serving as an output terminal of the current mirror circuit.

The operation of the constant current circuit of this embodiment is described next.

When the constant current circuit is powered on, the gate-source voltage of the depletion type NMOS transistor 10 is substantially 0 V, which causes a drain current to flow in the depletion type NMOS transistor 10. The drain current starts up the constant current circuit. The constant current circuit therefore does not need a start-up circuit for starting up the constant current circuit.

When the power supply voltage is given as VDD, the drain-source voltage of the depletion type NMOS transistor 10 is given as Vds10, and the gate-source voltage of the NMOS transistor 15 is given as Vgs15, the constant current circuit needs to satisfy the following Expression (1) to operate properly:

$$VDD > Vds10 + Vgs15 \quad (1)$$

From Expression (1), the power supply voltage VDD needs to be higher than 0.9 V in order for the constant current circuit to operate properly when, for example, the drain-source voltage Vds10 is 0.2 V and the gate-source voltage Vgs15 is 0.7 V. In other words, the constant current circuit has a minimum operating power supply voltage of 0.9 V, which is lower than the minimum operating power supply voltage in prior art.

Designing the circuit in a manner that makes the NMOS transistor 15 higher in threshold voltage than the NMOS transistor 11, and/or designing the circuit in a manner that makes the NMOS transistor 15 lower in driving performance than the NMOS transistor 11 gives the NMOS transistor 15 a gate-source voltage higher than that of the NMOS transistor 11. A differential voltage between the gate-source voltage of the NMOS transistor 15 and the gate-source voltage of the NMOS transistor 11 is generated in the resistor 20. A current Iref based on the differential voltage and the resistance value of the resistor 20 flows in the resistor 20. The current mirror circuit constituted of the NMOS transistors 11 and 12 and the current mirror circuit constituted of the PMOS transistors 13 and 14 cause a current based on the current Iref to flow in the drain of the NMOS transistor 15.

The depletion type NMOS transistor 10 and the NMOS transistor 15 operate in conjunction with each other such that the current Iref and the drain current of the NMOS transistor 15 have a desired current ratio. Specifically, in the case where the current Iref that flows in the resistor 20 is large, a high voltage is generated in the resistor 20 and a voltage VA rises as well. This raises the gate-source voltage of the NMOS transistor 15 and increases the conductance of the NMOS transistor 15. As a result, the gate voltage of the depletion type NMOS transistor 10 is lowered and the gate-source voltage of the depletion type NMOS transistor 10 drops as well, thereby reducing the conductance of the depletion type NMOS transistor 10. Then the voltage VA drops and the current Iref is accordingly reduced. In the case where the current Iref that flows in the resistor 20 is small, the current Iref increases by the mechanism described above. The current Iref is thus kept constant.

The current Iref that flows in the depletion type NMOS transistor 10, the resistor 20, and the NMOS transistor 11 is described next.

When a voltage at the other end of the resistor 20 is given as VA, a voltage at the one end of the resistor 20 is given as VB, and the resistance value of the resistor 20 is given as Rb, the following Expression (2) is established:

$$Iref = \frac{VA - VB}{Rb} \tag{2}$$

[When the Depletion Type NMOS Transistor 10 Operates in a Strong Inversion Mode and the Other Transistors Operate in a Strong Inversion Mode as Well]

When the MOS transistor has a gate-source voltage Vgs, a drain current I, a threshold voltage Vth, a mobility $\mu_n$, a gate insulating film capacity per unit area $C_{OX}$, a gate width W, and a gate length L, the following Expression (3) is established:

$$Vgs = \sqrt{\frac{2I}{\beta}} + Vth\left(\beta = \mu_n C_{ox}\frac{W}{L}\right) \tag{3}$$

When the NMOS transistor 11 has a drain current I11 and a threshold voltage Vth11 and the NMOS transistor 15 has a drain current I15 and a threshold voltage Vth15, the following Expression (4) is established from Expressions (2) and (3):

$$Iref = I11 = \frac{VA - VB}{Rb} = \frac{\sqrt{\frac{2I15}{\beta 15}} - \sqrt{\frac{2I11}{\beta 11}} + Vth15 - Vth11}{Rb} \tag{4}$$

In the case where the following Expression (5) and Vth15>Vth11 are satisfied, the following Expression (6) is established from Expression (4):

$$\sqrt{\frac{2I15}{\beta 15}} - \sqrt{\frac{2I11}{\beta 11}} = 0 \tag{5}$$

$$Iref = \frac{Vth15 - Vth11}{Rb} \tag{6}$$

The NMOS transistor 11 and the NMOS transistor 15 are transistors having the same polarity, and the threshold voltage Vth11 and the threshold voltage Vth15 therefore have substantially the same temperature characteristics, which means that the temperature coefficient of (Vth15−Vth11) is substantially 0. If the resistor 20 used has 0 as the temperature coefficient of the resistance value Rb, the temperature coefficient of the current Iref, too, is substantially 0. It is also concluded from Expression (6) that the current Iref is independent of the power supply voltage VDD.

In the case where Vth15−Vth11=0, Iref=I11=I15, β15=β, and β11=αβ (α is a constant number that satisfies α>1) are satisfied, the following Expression (7) is established from Expression (4). From Expression (7), the following Expression (8) is established. From Expression (8), the following Expression (9) is established:

$$\begin{aligned} Iref &= \frac{\sqrt{\frac{2I15}{\beta 15}} - \sqrt{\frac{2I11}{\beta 11}}}{Rb} \\ &= \frac{\sqrt{\frac{2Iref}{\beta}} - \sqrt{\frac{2Iref}{\beta}}}{Rb} \\ &= \frac{\sqrt{\frac{2Iref}{\beta}}}{Rb}\left(1 - \frac{1}{\sqrt{a}}\right) \end{aligned} \tag{7}$$

$$\sqrt{Iref}\left(\sqrt{Iref} - \frac{\sqrt{\frac{2}{\beta}}}{Rb}\left(1 - \frac{1}{\sqrt{a}}\right)\right) = 0 \tag{8}$$

$$Iref = \frac{1}{Rb^2}\cdot\sqrt{\frac{2}{\beta}}\cdot\left(1 - \frac{1}{\sqrt{a}}\right)^2 \tag{9}$$

If the resistor 20 used has the resistance value Rb whose temperature characteristics cancel out the temperature characteristics of β, the temperature coefficient of the current Iref is 0 as well. It is also concluded from Expression (9) that the current Iref is independent of the power supply voltage VDD.

[When the Depletion Type NMOS Transistor 10 Operates in a Strong Inversion Mode and the Other Transistors Operate in a Weak Inversion Mode]

When the MOS transistor has a slope factor n, a Boltzmann constant k, a temperature T, an electronic charge q, and a process-dependent parameter $I_0$, the following Expression (10) is established:

$$Vgs = \frac{nkT}{q}\ln\left(\frac{I}{I_0 K}\right) + Vth \quad \left(K = \frac{W}{L}\right) \tag{10}$$

The following Expression (11) is established from Expressions (2) and (10):

$$\begin{aligned} Iref &= I11 \\ &= \frac{VA - VB}{Rb} \\ &= \frac{\frac{nkT}{q}\ln\left(\frac{I15}{I_0 K15}\right) - \frac{nkT}{q}\ln\left(\frac{I11}{I_0 K11}\right) + Vth15 - Vth11}{Rb} \end{aligned} \tag{11}$$

In the case where the following Expression (12) and Vth15>Vth11 are satisfied, the following Expression (13) is established from Expression (11):

$$\frac{nkT}{q}\ln\left(\frac{I15}{I_0 K15}\right) - \frac{nkT}{q}\ln\left(\frac{I11}{I_0 K11}\right) = 0 \tag{12}$$

$$Iref = \frac{Vth15 - Vth11}{Rb} \tag{13}$$

The temperature coefficient of the current Iref is substantially 0 as in the case where the other transistors operate in a strong inversion mode. It is also concluded from Expression (13) that the current Iref is independent of the power supply voltage VDD.

Further, in the case where Vth15−Vth11=0 and Iref=I11=γ15 (γ>0) are satisfied, the following Expression (14) is established from Expression (11):

$$Iref = \frac{\frac{nkT}{q}\ln\left(\frac{I15}{I_0K15}\right) - \frac{nkT}{q}\ln\left(\frac{I11}{I_0K11}\right)}{Rb} = \frac{\frac{nkT}{q}\ln\left(\frac{I15K11}{I11K15}\right)}{Rb} = \frac{\frac{nkT}{q}\ln\left(\frac{\gamma K11}{K15}\right)}{Rb} \quad (14)$$

If the resistor 20 used has the resistance value Rb whose temperature characteristics cancel out the temperature characteristics of the numerator of Expression (14), the temperature coefficient of the current Iref is 0 as well. It is also concluded from Expression (14) that the current Iref is independent of the power supply voltage VDD.

Structured in this manner, the constant current circuit can operate if the power supply voltage VDD is higher than a voltage that is the sum of the drain-source voltage Vds10 of the depletion type NMOS transistor 10 and the gate-source voltage Vgs15 of the NMOS transistor 15. The constant current circuit needs as the power supply voltage VDD a voltage that is the sum of one drain-source voltage and one gate-source voltage, instead of a voltage that is the sum of one drain-source voltage and two gate-source voltages, and therefore is reduced in minimum operating power supply voltage.

The constant current circuit structured as above also does not need a start-up circuit for starting up the constant current circuit.

Modification Example 1

Figure 2:
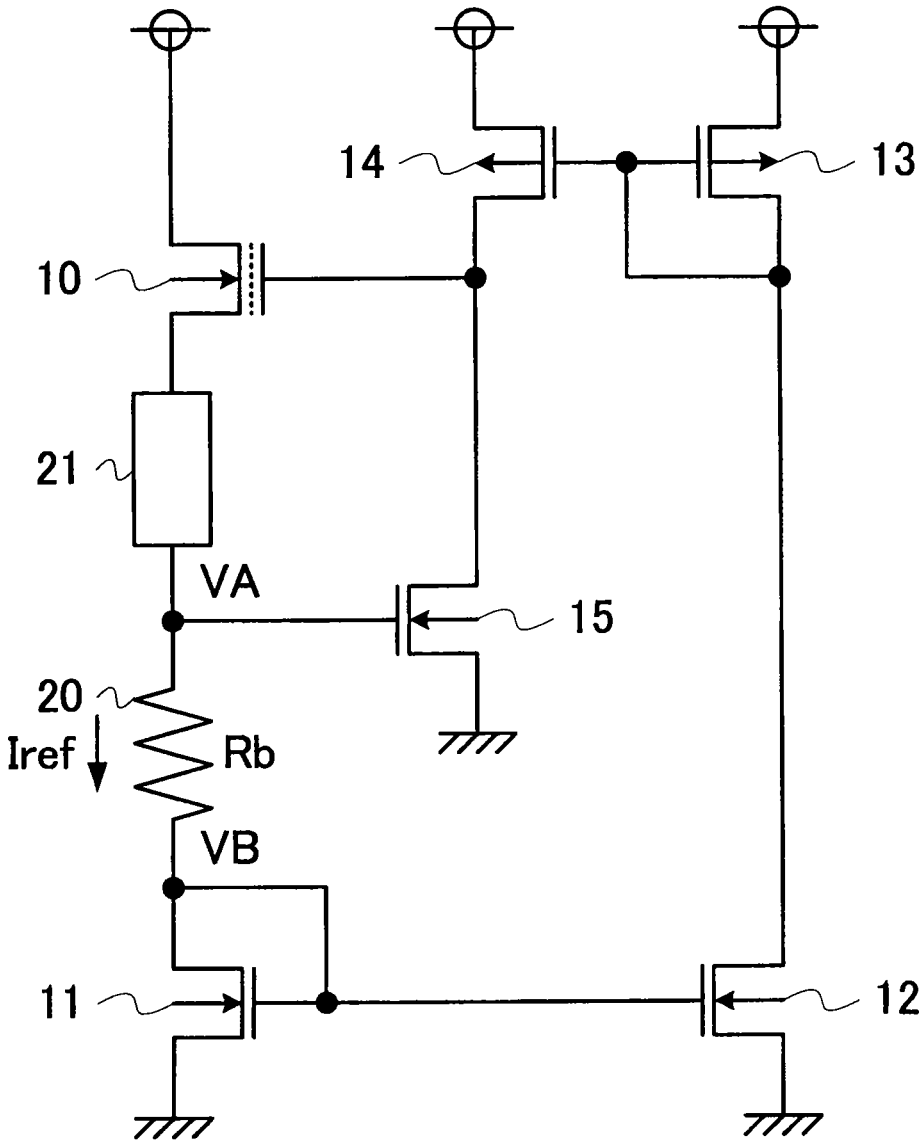
FIG. 2 is a diagram illustrating another example of the constant current circuit according to the embodiment.

FIG. 2 is a diagram illustrating another example of the constant current circuit according to this embodiment. Compared to FIG. 1, an impedance element 21, which is constituted of a resistor, a MOS transistor wired in a saturated manner, a diode, and others, is added in FIG. 2. The impedance element 21 is provided between the source of the depletion type NMOS transistor 10 and a point where the other end of the resistor 20 and the gate of the NMOS transistor 15 are connected to each other.

With this structure, a voltage is generated in the impedance element 21 based on the current Iref, and the source voltage and the gate voltage of the depletion type NMOS transistor 10 are consequently higher than in the circuit of FIG. 1. The drain-source voltage of the NMOS transistor 15 is therefore high, which prompts the NMOS transistor 15 to operate in a saturation mode.

Modification Example 2

Figure 3:
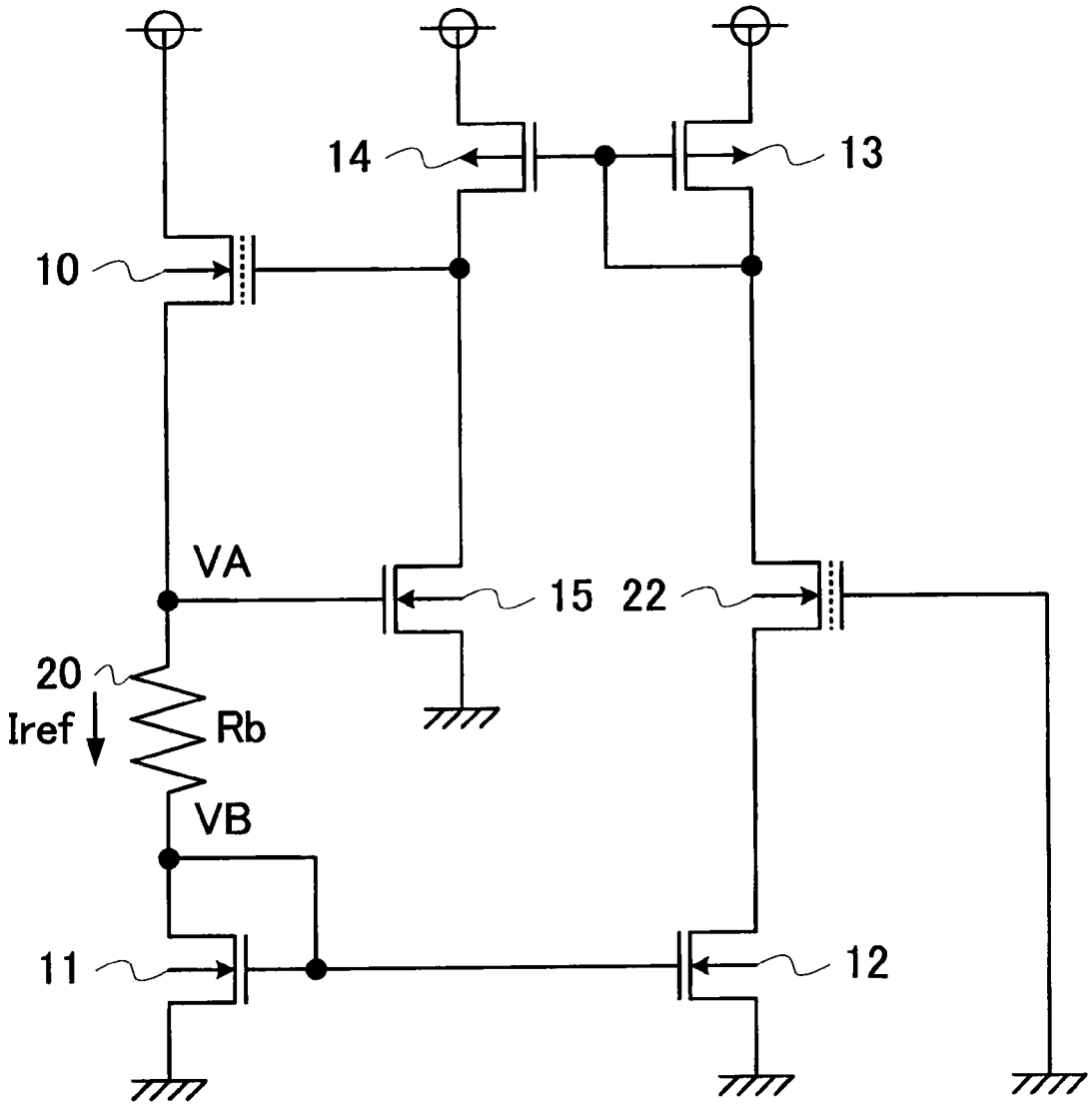
FIG. 3 is a diagram illustrating still another example of the constant current circuit according to the embodiment.

FIG. 3 is a diagram illustrating still another example of the constant current circuit according to this embodiment. Compared to FIG. 1, a depletion type NMOS transistor 22 is added in FIG. 3 as a cascode circuit of the NMOS transistor 12. The depletion type NMOS transistor 22 has a gate connected to the ground terminal, a source connected to the drain of the NMOS transistor 12, and a drain connected to the drain of the PMOS transistor 13.

With this circuit structure, a fluctuation in the power supply voltage VDD which causes a fluctuation in the drain voltage of the PMOS transistor 13 hardly changes the drain voltage of the NMOS transistor 12. The current mirror circuit constituted of the NMOS transistors 11 and 12 thus maintains the desired current ratio. Other circuit structures, too, can have a cascode circuit added to the drain of the NMOS transistor 12.

Modification Example 3

Figure 4:
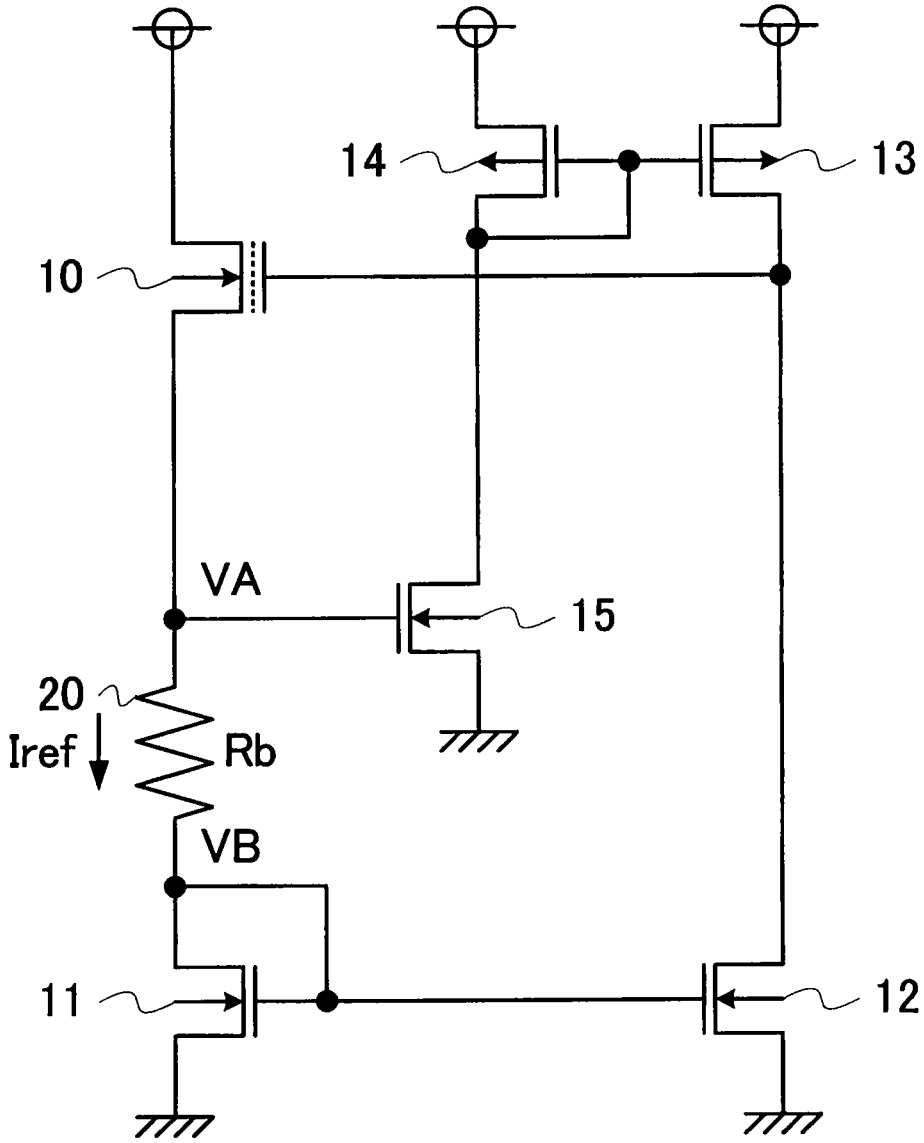
FIG. 4 is a diagram illustrating yet still another example of the constant current circuit according to the embodiment.

FIG. 4 is a diagram illustrating yet still another example of the constant current circuit according to this embodiment. FIG. 4 differs from FIG. 1 in that the gate of the depletion type NMOS transistor 10 is connected to the drain of the PMOS transistor 13 and that the gates of the PMOS transistors 13 and 14 are connected to the drain of the PMOS transistor 14.

With the transistors connected in this manner, the gate voltage of the depletion type NMOS transistor 10 is controlled based on a relation between a current of the NMOS transistor 12 which mirrors the current Iref and a current of the PMOS transistor 13 which mirrors a current caused by the voltage VA to flow in the NMOS transistor 15. As in other examples, the circuit of this Modification Example 3 operates in a manner that keeps the current Iref constant even if the current Iref changes.

Modification Example 4

Figure 5:
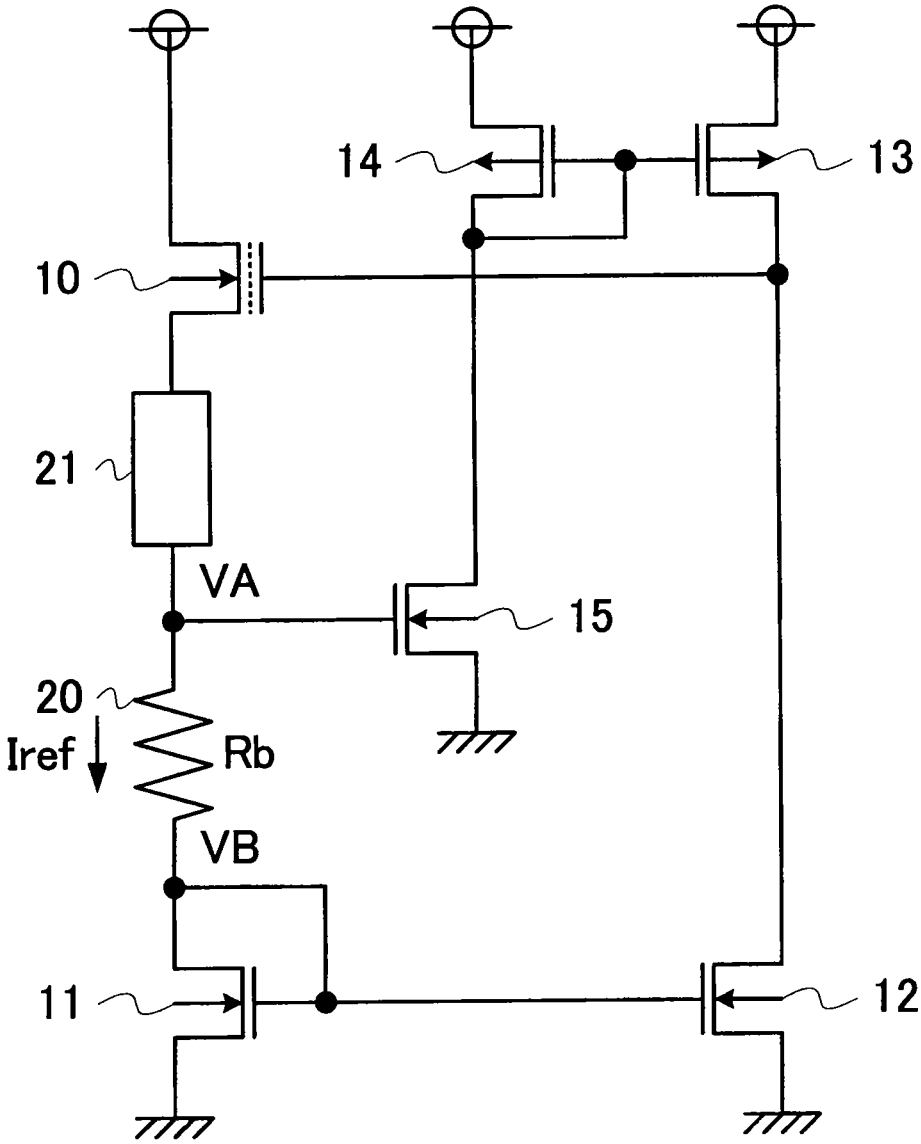
FIG. 5 is a diagram illustrating yet still another example of the constant current circuit according to the embodiment.

FIG. 5 is a diagram illustrating yet still another example of the constant current circuit according to this embodiment. Compared to FIG. 4, the impedance element 21 is added in FIG. 5. The impedance element 21 is provided between the source of the depletion type NMOS transistor 10 and a point where the other end of the resistor 20 and the gate of the NMOS transistor 15 are connected to each other. This way, the NMOS transistor 15 is prompted to operate in a saturation mode as in Modification Example 1.

Modification Example 5

Figure 6:
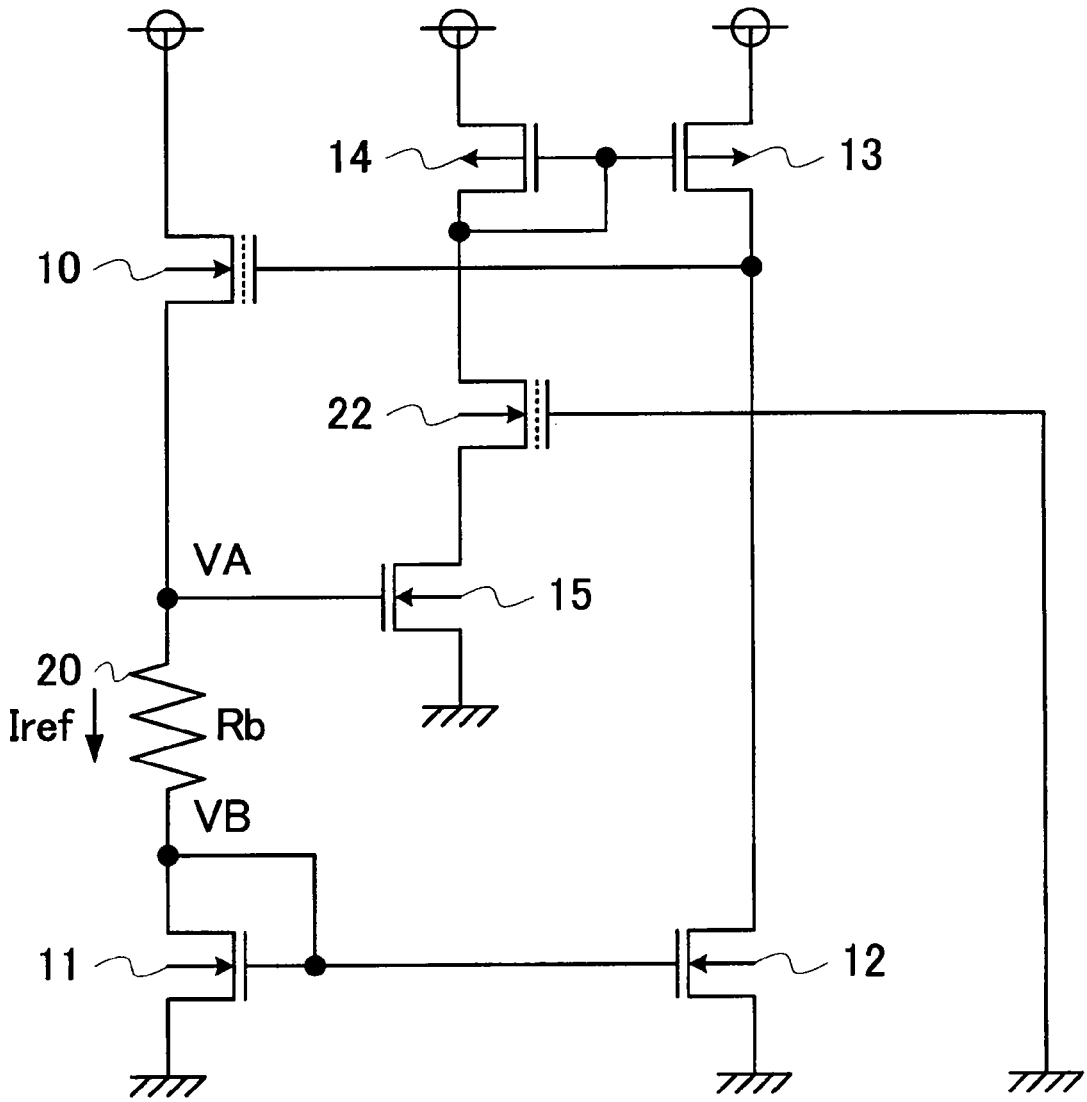
FIG. 6 is a diagram illustrating yet still another example of the constant current circuit according to the embodiment.

FIG. 6 is a diagram illustrating yet still another example of the constant current circuit according to this embodiment. Compared to FIG. 4, the depletion type NMOS transistor 22 is added in FIG. 6 as a cascode circuit of the NMOS transistor 15. The depletion type NMOS transistor 22 has a gate connected to the ground terminal, a source connected to the drain of the NMOS transistor 15, and a drain connected to the drain of the PMOS transistor 14.

With this circuit structure, a fluctuation in the power supply voltage VDD which causes a fluctuation in the drain voltage of the PMOS transistor 14 hardly changes the drain voltage of the NMOS transistor 15. Therefore, the drain current of the NMOS transistor 15 does not change as well. Other circuit structures can have a cascode circuit added to the drain of the NMOS transistor 15.

Modification Example 6

Figure 7:
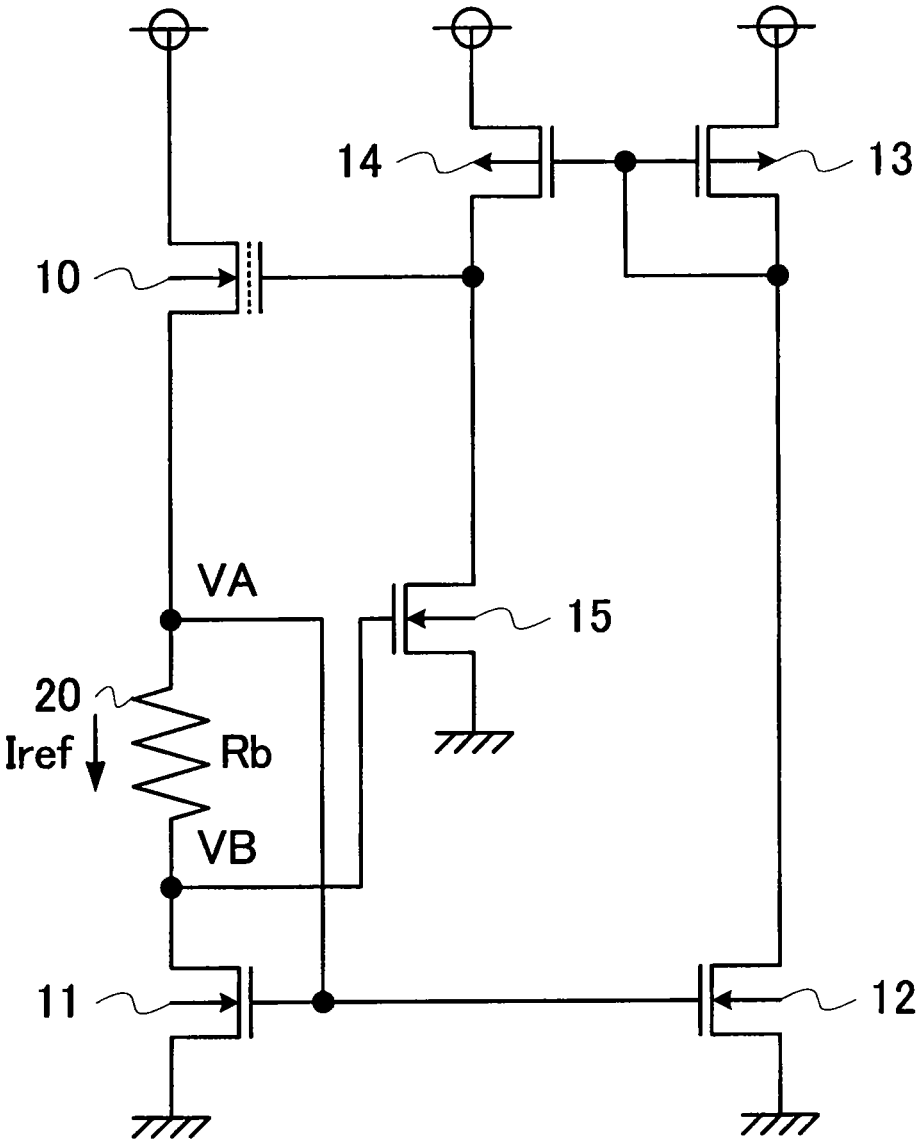
FIG. 7 is a diagram illustrating yet still another example of the constant current circuit according to the embodiment.

FIG. 7 is a diagram illustrating yet still another example of the constant current circuit according to this embodiment. FIG. 7 differs from FIG. 1 in that the gate of the NMOS transistor 15 is connected to a point where the drain of the NMOS transistor 11 and the resistor 20 are connected to each other, and that the gates of the NMOS transistors 11 and 12 are connected to a point where the source of the depletion type NMOS transistor 10 and the resistor 20 are connected to each other. The gate-source voltage of the NMOS transistor 15 which, in the circuit design of FIG. 1, is higher than the gate-source voltage of the NMOS transistor 11 is lower than the gate-source voltage of the NMOS transistor 11 in FIG. 7.

Modification Example 7

Figure 8:
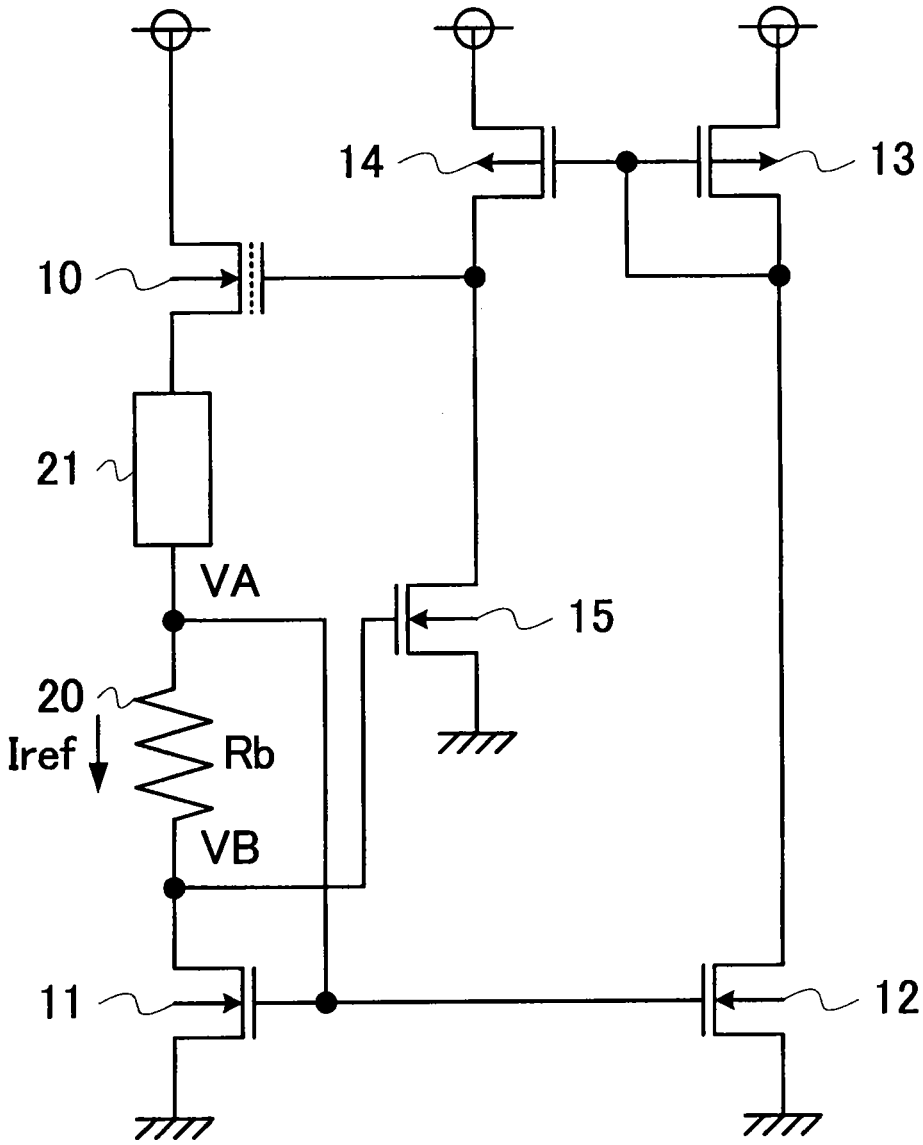
FIG. 8 is a diagram illustrating yet still another example of the constant current circuit according to the embodiment.

FIG. 8 is a diagram illustrating yet still another example of the constant current circuit according to this embodiment. FIG. 8 differs from FIG. 2 in that the gates of the NMOS transistors 11 and 12 and the gate of the NMOS transistor 15 are connected in the manner described in Modification Example 6. The circuit design of FIG. 8 is such that the gate-source voltage of the NMOS transistor 15 is lower than the gate-source voltage of the NMOS transistor 11.

Modification Example 8

Figure 9:
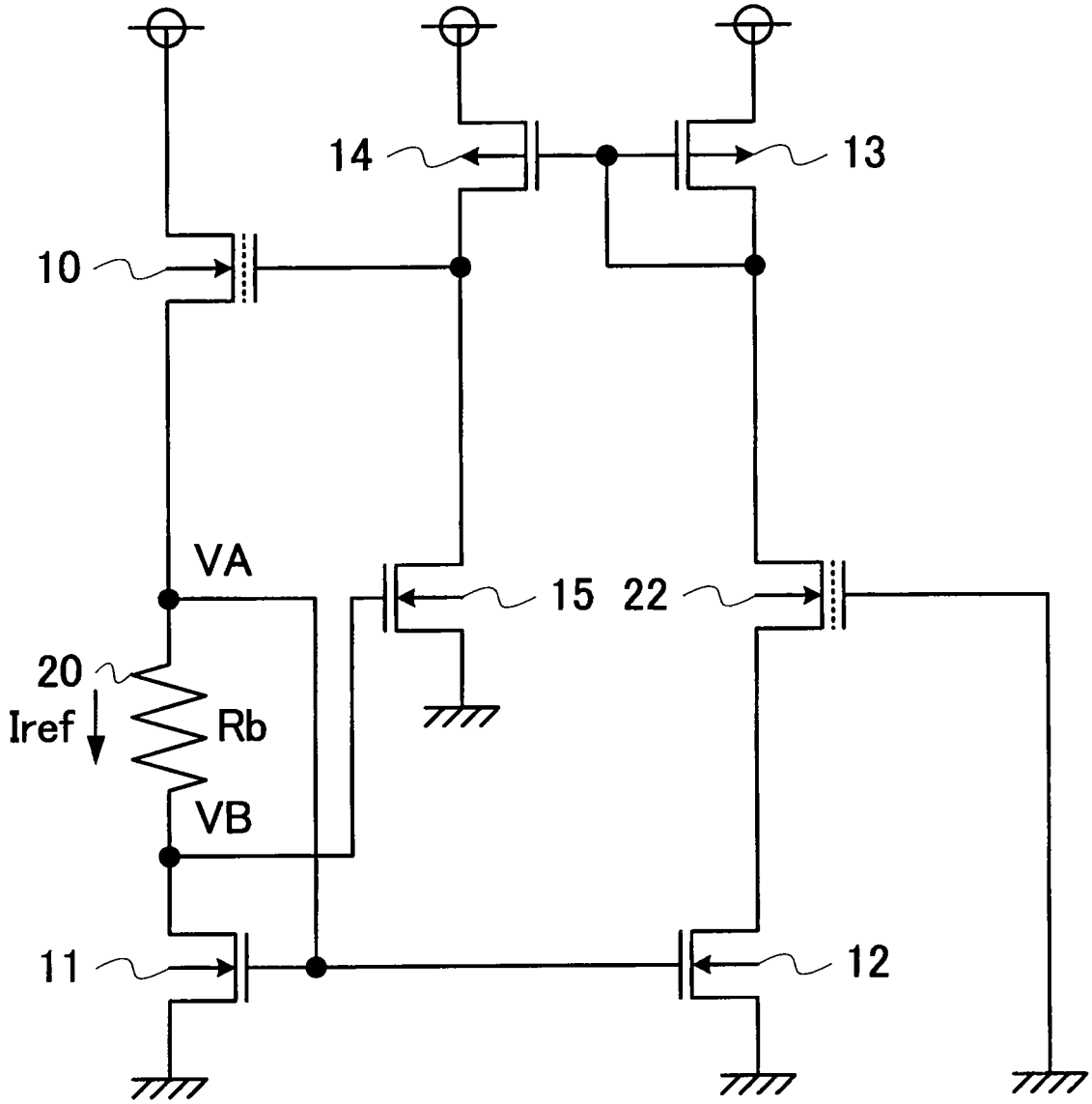
FIG. 9 is a diagram illustrating yet still another example of the constant current circuit according to the embodiment.

FIG. 9 is a diagram illustrating yet still another example of the constant current circuit according to this embodiment. FIG. 9 differs from FIG. 3 in that the gates of the NMOS transistors 11 and 12 and the gate of the NMOS transistor 15 are connected in the manner described in Modification Example 6. The circuit design of FIG. 9 is such that the gate-source voltage of the NMOS transistor 15 is lower than the gate-source voltage of the NMOS transistor 11.

Modification Example 9

Figure 10:
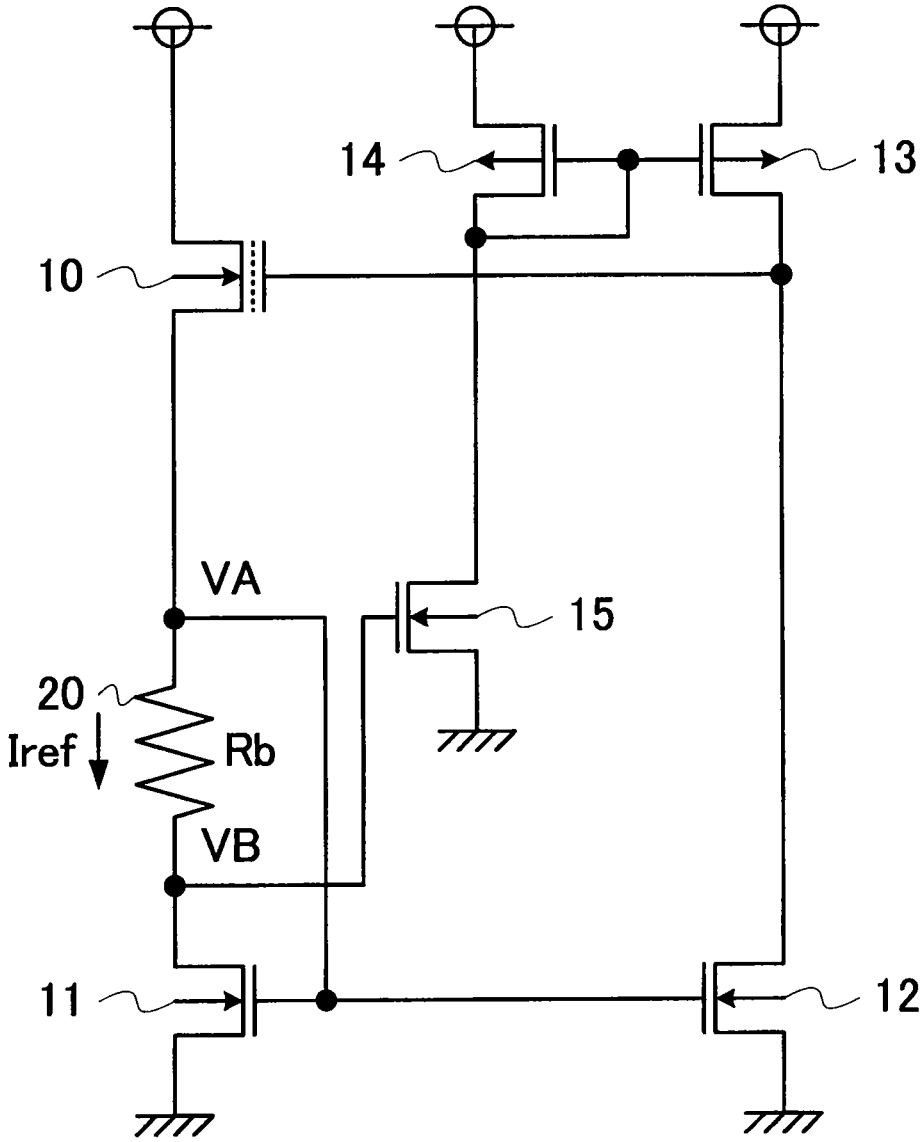
FIG. 10 is a diagram illustrating yet still another example of the constant current circuit according to the embodiment.

FIG. 10 is a diagram illustrating yet still another example of the constant current circuit according to this embodiment. FIG. 10 differs from FIG. 4 in that the gates of the NMOS transistors 11 and 12 and the gate of the NMOS transistor 15 are connected in the manner described in Modification Example 6. The circuit design of FIG. 10 is such that the gate-source voltage of the NMOS transistor 15 is lower than the gate-source voltage of the NMOS transistor 11.

Modification Example 10

Figure 11:
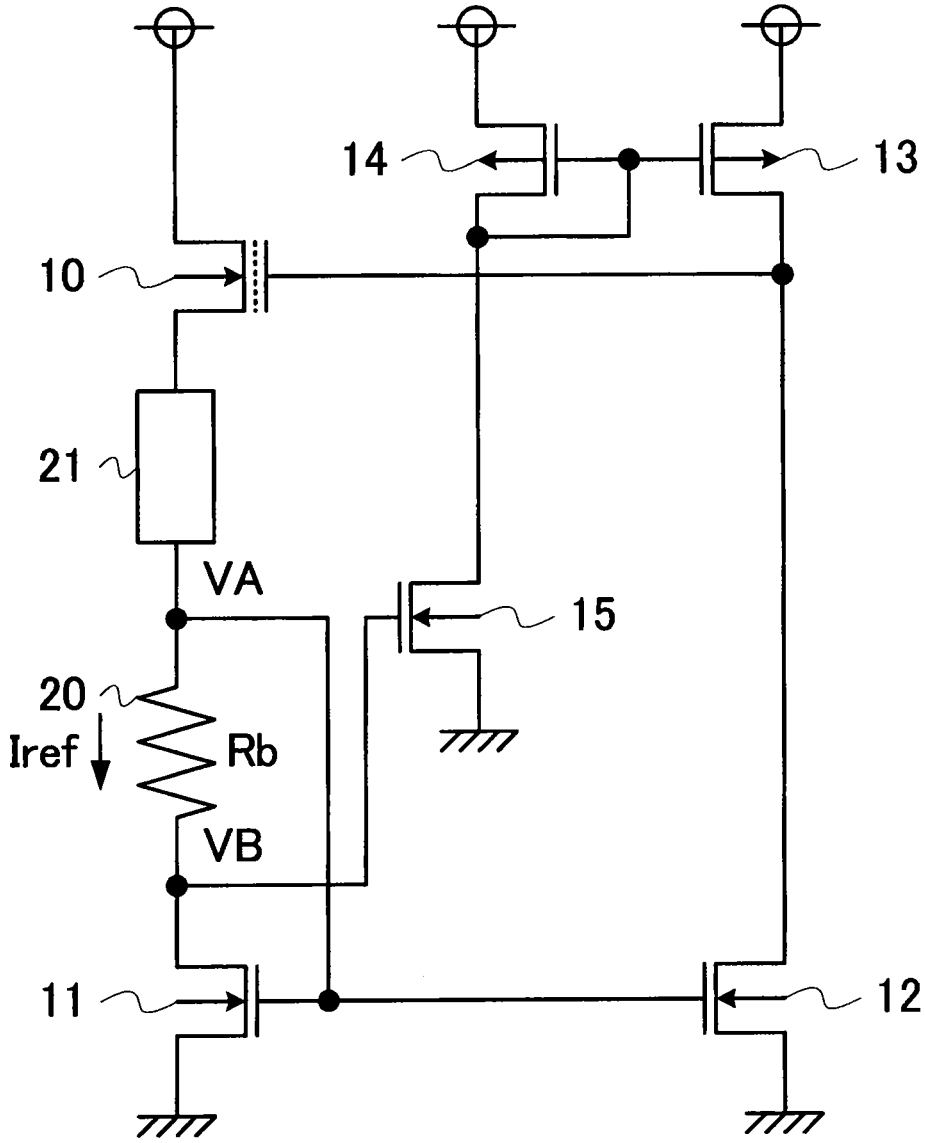
FIG. 11 is a diagram illustrating yet still another example of the constant current circuit according to the embodiment.

FIG. 11 is a diagram illustrating yet still another example of the constant current circuit according to this embodiment. FIG. 11 differs from FIG. 5 in that the gates of the NMOS transistors 11 and 12 and the gate of the NMOS transistor 15 are connected in the manner described in Modification Example 6. The circuit design of FIG. 11 is such that the gate-source voltage of the NMOS transistor 15 is lower than the gate-source voltage of the NMOS transistor 11.

Modification Example 11

Figure 12:
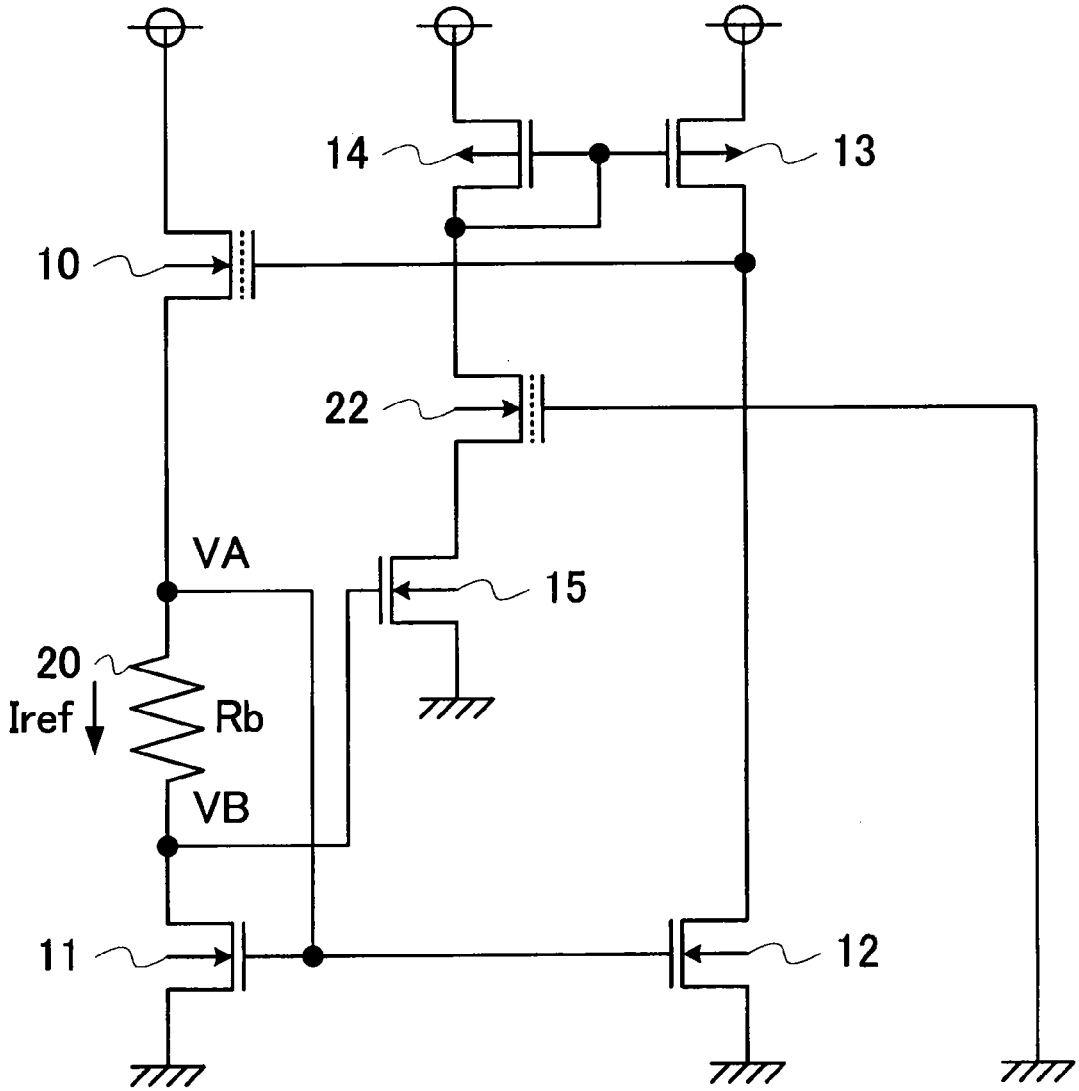
FIG. 12 is a diagram illustrating yet still another example of the constant current circuit according to the embodiment.
Figure 13:
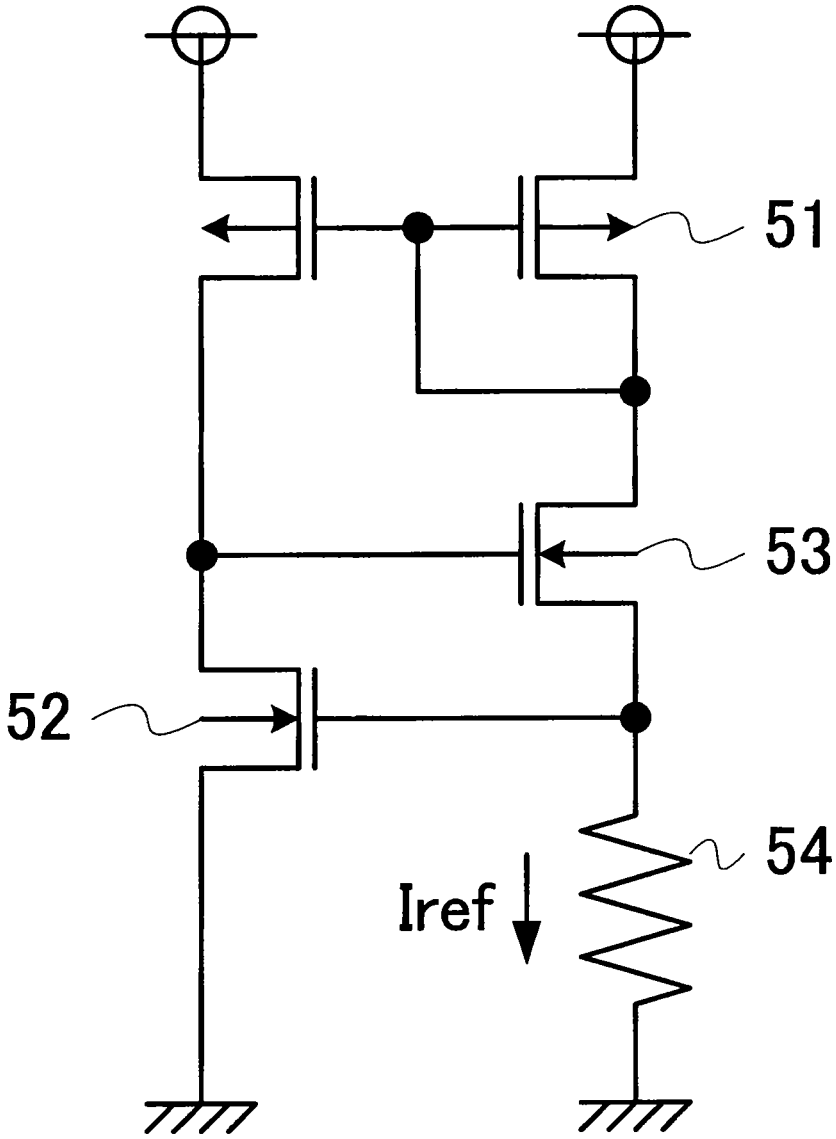
FIG. 13 PRIOR ART
FIG. 13 is a diagram illustrating a conventional constant current circuit.

FIG. 12 is a diagram illustrating yet still another example of the constant current circuit according to this embodiment. FIG. 12 differs from FIG. 6 in that the gates of the NMOS transistors 11 and 12 and the gate of the NMOS transistor 15 are connected in the manner described in Modification Example 6. The circuit design of FIG. 12 is such that the gate-source voltage of the NMOS transistor 15 is lower than the gate-source voltage of the NMOS transistor 11.

What is claimed is:

1. A constant current circuit, comprising:

a depletion type MOS transistor of a second conductivity type has a drain connected to a first power supply terminal providing a minimum of 0.9 volts and serves as a current source, wherein a drain current of the depletion type MOS transistor starts the constant current circuit in the absence of a start-up circuit;

a first current mirror circuit comprises a first MOS transistor of the second conductivity type serving as an input-side transistor and having a source connected to a ground terminal and a second MOS transistor of the second conductivity type serving as an output-side transistor and having a source connected to a second ground terminal, a gate of the first and second MOS transistors of the second conductivity type is connected to a drain of the first MOS transistor of the second conductivity type, and the first current mirror circuit mirrors a current that flows in the first depletion type MOS transistor of the second conductivity type;

a second current mirror circuit comprises a first MOS transistor of a first conductivity type serving as an input-side transistor and having a source connected to the first power supply terminal and a second MOS transistor of the first conductivity type serving as an output-side transistor and having a source connected to the first power supply terminal, a gate of the first and second MOS transistors of the first conductivity type is connected to a drain of the first MOS transistor of the first conductivity type, and the second current mirror circuit mirrors a current that flows in the first current mirror circuit;

a resistor coupled between a source of the depletion type MOS transistor of the second conductivity type and a drain of the first MOS transistor of the second conductivity type; and a third MOS transistor of the second conductivity type has a gate connected to one terminal of the resistor and to the drain of the first MOS transistor of the second conductivity type, a source connected to the ground terminal, and a drain connected to an output terminal of the second current mirror circuit, wherein the gate of the first MOS transistor of the second conductivity type is connected to another terminal of the resistor, and a gate of the depletion type MOS transistor of the second conductivity type is connected to the output terminal of the second current mirror circuit.

2. A constant current circuit according to claim 1, further comprising an impedance element coupled between the source of the depletion type MOS transistor of the second conductivity type and the resistor.

* * * * *